US007544041B2

(12) United States Patent
Mayleben et al.

(10) Patent No.: US 7,544,041 B2
(45) Date of Patent: Jun. 9, 2009

(54) PUMP WITH COMBINED FLOATING WEAR RING AND LIQUID DIRECTOR

(75) Inventors: Philip A. Mayleben, Edgewood, KY (US); Buford A. Cooper, Sunman, IN (US)

(73) Assignee: Wayne/Scott Fetzer Company, Harrison, OH (US)

( * ) Notice: Subject to any disclaimer, the term of this patent is extended or adjusted under 35 U.S.C. 154(b) by 583 days.

(21) Appl. No.: 11/134,647

(22) Filed: May 20, 2005

(65) Prior Publication Data

US 2006/0275162 A1 Dec. 7, 2006

(51) Int. Cl.
*F01D 11/08* (2006.01)

(52) U.S. Cl. ..... 415/171.1; 415/173.6; 415/206

(58) Field of Classification Search ..... 415/171.1, 415/173.6, 196, 203, 204, 205, 206
See application file for complete search history.

(56) References Cited

U.S. PATENT DOCUMENTS 4,586,204 A 5/1986 Daniels
4,661,041 A 4/1987 Hessler
4,909,707 A 3/1990 Wauligman
5,156,535 A 10/1992 Budris
5,408,708 A 4/1995 Mathis
5,701,388 A 12/1997 Steinhardt
5,915,921 A * 6/1999 Sabini ..... 415/173.1
5,930,852 A 8/1999 Gravatt
6,056,506 A 5/2000 Martin
6,102,657 A 8/2000 Chalberg
6,402,462 B1 6/2002 Dipl.-Ing.

OTHER PUBLICATIONS

ITT Industries, "H" Series Whirlpool Bath Pump, Product Specification Sheet, p. 71.
ITT Industries, HydroAir "H" series Whirlpool Bath Pump, http://www.hydroairusa.com/products/bathPumps/H_SeriesPumps.htm, Mar. 18, 2004.

* cited by examiner

*Primary Examiner*—Edward Look
*Assistant Examiner*—Dwayne J White
(74) *Attorney, Agent, or Firm*—Jones Day

(57) ABSTRACT

A pump has a one piece combined floating wear ring and liquid director that includes an upper ring portion received over an impeller hub and a curved lower portion that separates the pump impeller and suction chambers and directs liquid from the suction chamber inlet port to the impeller inlet.

3 Claims, 4 Drawing Sheets

PUMP WITH COMBINED FLOATING WEAR RING AND LIQUID DIRECTOR

BACKGROUND

This application relates to the art of pumps and, more particularly, to impeller pumps that have a floating wear ring around the impeller hub to minimize leakage from the impeller chamber to the suction chamber. Pumps of this type usually have a separate water director that often is glued in place within the suction chamber housing for directing water to the eye of the impeller.

SUMMARY

A pump of the type described has a one-piece combined floating wear ring and water director that is configured to minimize leakage from the pressurized impeller chamber to the suction chamber during pump operation while allowing complete draining of the impeller chamber to the suction chamber when the pump is turned off.

The combined floating wear ring and water director has an upper ring portion received over the impeller hub, and a lower depending portion with a curved surface facing toward the suction chamber. The curved surface terminates in a toe portion from which a generally horizontal bottom wall extends rearwardly closely adjacent the suction chamber bottom wall.

A flange around all but the bottom peripheral portion of the combined wear ring and water director cooperates with a shoulder on the suction chamber housing. The combined wear ring and water director is self-aligning by way of the flange and shoulder, and the pressure difference between the impeller and suction chambers. The depending portion and bottom wall of the combined wear ring and water director have sufficient flexibility and play to minimize leakage from the impeller chamber to the suction chamber, while having sufficient clearance to drain the impeller chamber to the suction chamber when the pump is not operating.

DESCRIPTION

Figure 1:
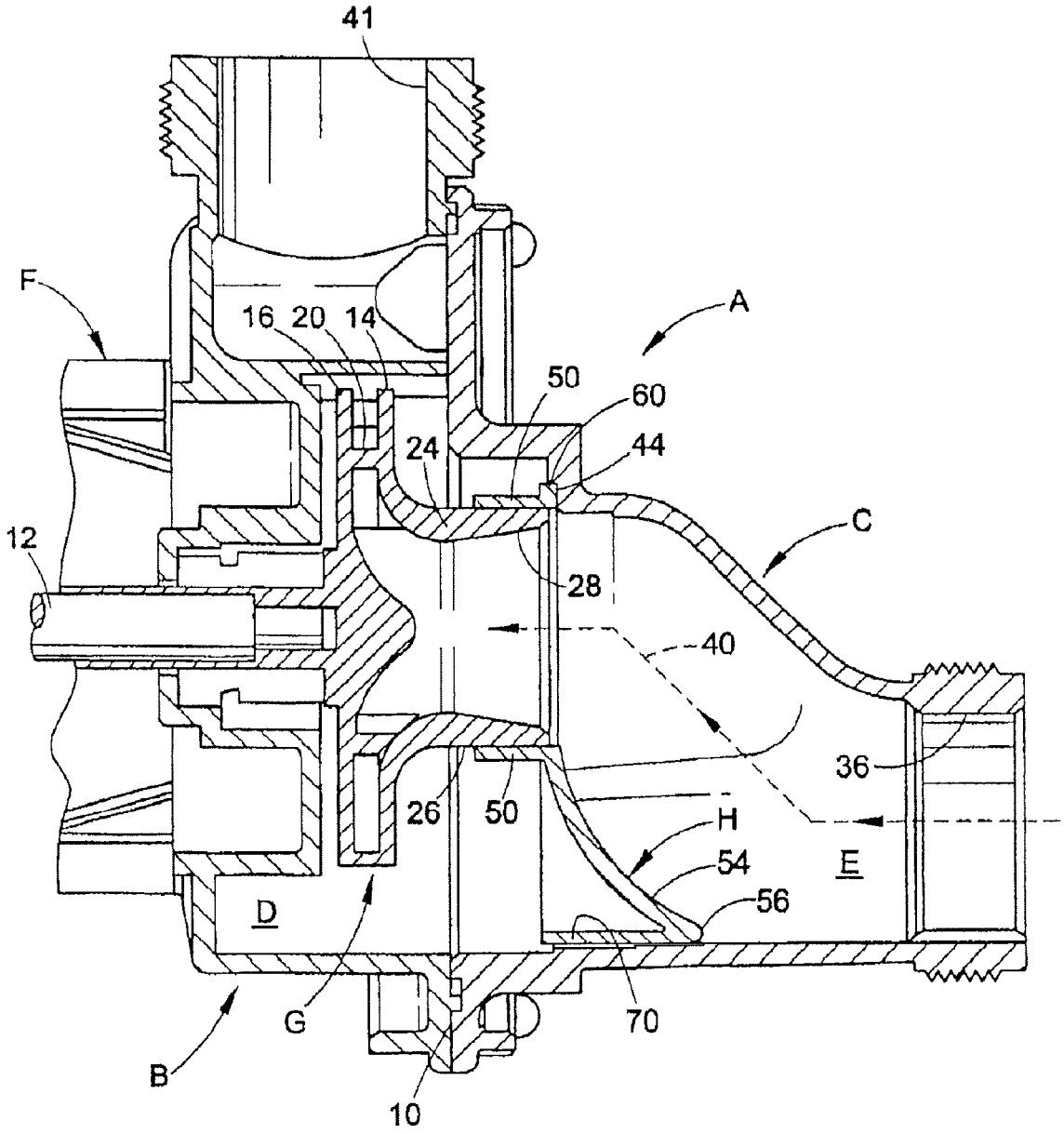
FIG. 1 is a cross-sectional elevational view of a pump having the improvements of the present application incorporated therein.

Referring now to the drawing, wherein the showings are for purposes of illustrating a representative embodiment of the invention only and not for purposes of limiting same, FIG. 1 shows a pump housing A having an impeller chamber housing part B and a suction chamber housing part C. Housing parts B and C are secured together at an interface 10 by suitable fasteners to provide an impeller chamber D and a suction chamber E.

A motor F attached to housing A has a rotatable shaft 12 on which an impeller G is mounted. Impeller G has spaced front and rear impeller walls 14, 16 between which one or more spiral-like vanes 20 curve outwardly in a direction from the impeller rotational axis toward the impeller outer periphery.

Impeller G has a generally cylindrical impeller hub 24 coaxial with the rotational axis of shaft 12 and impeller G. Hub 24 has a generally cylindrical outer surface 26 and surrounds a central cylindrical impeller inlet 28.

Suction chamber housing part C has an inlet port 36 positioned below inlet 28 and communicates therewith by way of an upwardly inclined passage that is generally indicated by dotted arrow 40. Rotation of impeller G draws water in through inlet port 36 and discharges same through generally radial pump outlet port 41.

Figure 2:
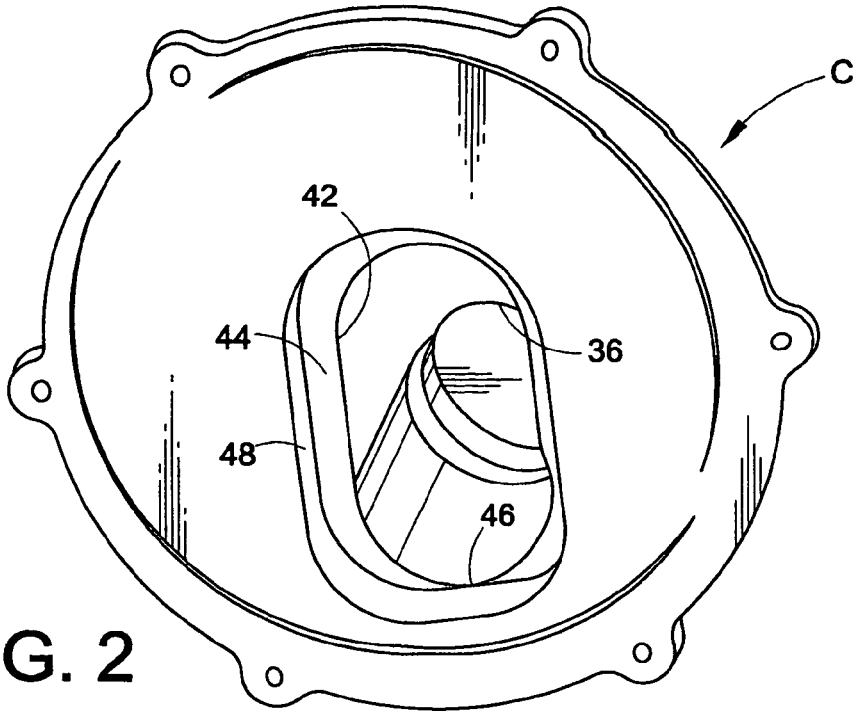
FIG. 2 is a rear perspective illustration of a suction chamber housing part.
Figure 3:
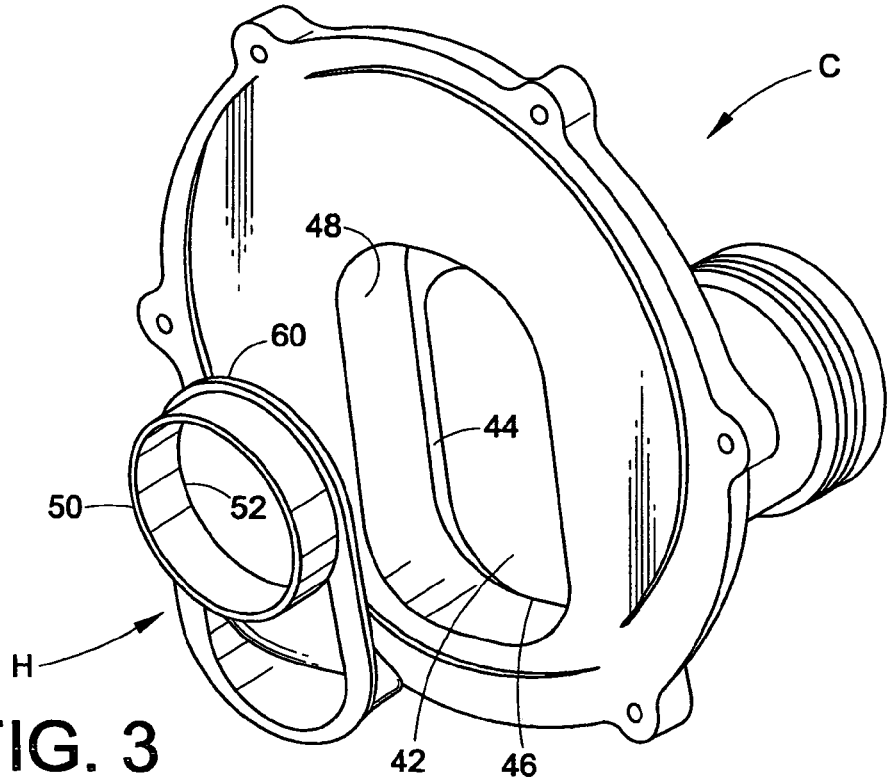
FIG. 3 is an exploded perspective illustration showing the rear of a suction chamber housing part along with a combined floating wear ring and liquid director.
Figure 4:
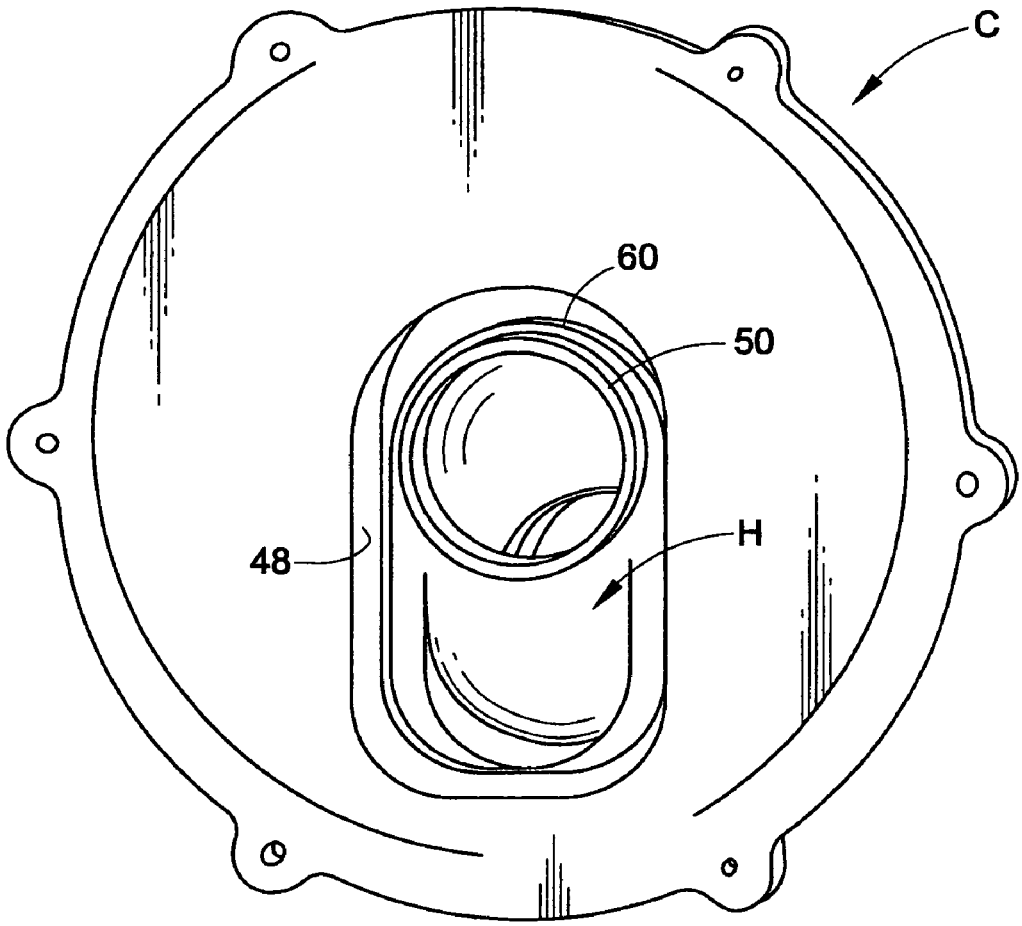
FIG. 4 is a rear perspective illustration showing the combined floating wear ring and liquid director installed in an oblong opening in the rear of the suction chamber housing part.

As best shown in FIG. 2, suction chamber housing part C has a vertically elongated oblong opening 42 that is surrounded by a flat shoulder 44 that extends around the entire periphery of opening 42 except at the bottom portion 46 thereof where there is no shoulder. A recess 48 in the rear face of suction chamber housing part C surrounds shoulder 44 and is an extension of opening bottom portion 46.

Figure 5:
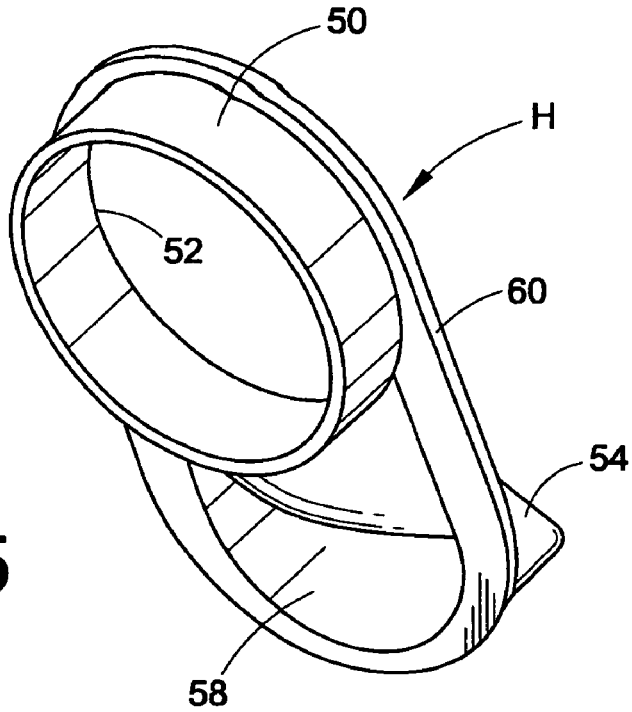
FIG. 5 is a rear perspective illustration of a combined floating wear ring and liquid director in accordance with the present application.
Figure 6:
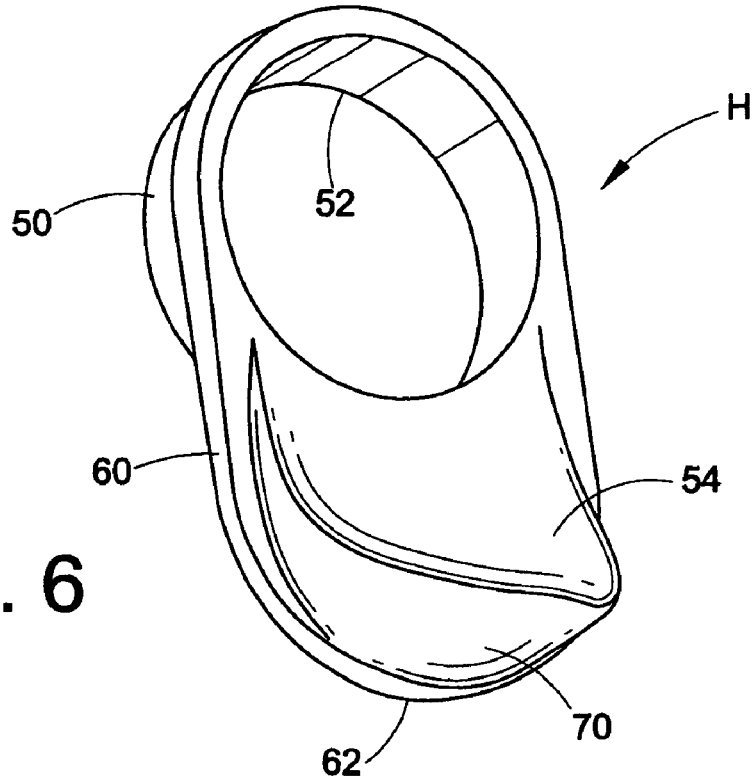
FIG. 6 is a front perspective illustration of a combined floating wear ring and a liquid director in accordance with the present application.

With reference to FIGS. 5 and 6, a combined wear ring and water director H is molded in one-piece of synthetic plastic material. An upper cylindrical ring portion 50 surrounds a cylindrical opening 52 that is configured for close reception over the generally cylindrical outer surface 26 of impeller hub 24. Impeller hub 24 rotates relative to ring portion 50.

A liquid directing portion that extends downwardly from ring 50 has a generally concavely curved front surface 54 extending from opening 52 towards suction chamber inlet port 36 as shown in FIG. 1. Front surface 54 terminates at a toe portion 56, and a generally horizontal bottom wall 70 extends rearwardly from toe portion 56.

The rear of the downwardly extending liquid directing portion has a cavity 58 therein as shown in FIG. 5 so that the walls of combined floating wear ring and liquid director H have a generally uniform thickness. A peripheral flange 60 extends outwardly around the outer periphery of combined wear ring and liquid deflector H except along an arcuate portion 62 at the bottom thereof. Combined wear ring and water director H is receivable within recess 48 around shoulder 44 in suction chamber housing part C with flange 60 engaging shoulder 44. Curved front surface 54 and toe portion 56 project through opening 52.

During operation of the pump, pressure within impeller chamber D urges combined wear ring and water director H to the right in FIG. 1 so that flange 60 is pressed against shoulder 44 to minimize any leakage from the pressurized impeller chamber D back into suction chamber E. The close rotational fit between the outer surface 26 of impeller hub 24 and the interior surface of opening 52 in ring 50 also minimizes any leakage from impeller chamber D back to suction chamber E.

The downwardly extending portion of combined wear ring and liquid deflector H separates impeller chamber D from suction chamber E as shown in FIG. 1. The bottom wall 70 of combined wear ring and water director is positioned closely adjacent to the bottom portion of recess 48 and the bottom of suction chamber E. Pressure within impeller chamber D may flex bottom wall 70 and/or the downwardly extending portion of combined wear ring and liquid director H to further minimize any leakage from impeller chamber D to suction chamber E.

When the pump is stopped, all of the liquid in impeller chamber D can drain to suction chamber E and through port 36 by flowing between the slight clearance between the outer bottom surface of bottom wall 70 on combined wear ring and liquid director H and the bottom surface of suction chamber E.

Combined floating wear ring and liquid director H is not fixed in position, and is free to shift slightly while providing little or no leakage from impeller chamber D to suction chamber E.

Although the improvements of this application have been shown and described with reference to a representative embodiment, it is obvious that alterations and modifications will occur to others skilled in the art upon the reading and understanding of this disclosure. Therefore, it is to be understood that the improvements may be practiced otherwise than as specifically described herein while remaining within the scope of the claims.

What is claimed is:

1. An apparatus comprising:

a pump having an impeller chamber and a suction chamber, a rotatable impeller in said impeller chamber and having a generally cylindrical impeller hub surrounding an axial impeller inlet, said suction chamber having a suction inlet port below said impeller inlet and an upwardly inclined passage from said suction inlet port to said impeller inlet, a one-piece combined wear ring and liquid director having a cylindrical ring portion received on said hub, said wear ring and liquid director having a curved liquid directing portion extending downwardly from said ring portion toward said suction inlet port to separate said impeller chamber from said suction chamber and form part of said inclined passage, and said liquid directing portion providing clearance to drain said impeller chamber to said suction chamber;

wherein said combined wear ring and liquid director has a peripheral flange extending outwardly from all but the bottom peripheral portion thereof, said pump having a housing with impeller and suction chamber housing parts, said suction housing part having an opening facing toward said impeller, said opening having a peripheral shoulder extending around all but the bottom peripheral portion thereof, and said peripheral flange being in engagement with said peripheral shoulder.

2. An apparatus comprising:

a pump having an impeller chamber and a suction chamber, a rotatable impeller in said impeller chamber and having a generally cylindrical impeller hub surrounding an axial impeller inlet, said suction chamber having a suction inlet port below said impeller inlet and an upwardly inclined passage from said suction inlet port to said impeller inlet, a one-piece combined wear ring and liquid director having a cylindrical ring portion received on said hub, said wear ring and liquid director having a curved liquid directing portion extending downwardly from said ring portion toward said suction inlet port to separate said impeller chamber from said suction chamber and form part of said inclined passage, and said liquid directing portion providing clearance to drain said impeller chamber to said suction chamber;

wherein said combined wear ring and liquid director is deflectable to close said clearance under pressure within said impeller chamber when the pump is operating.

3. An apparatus comprising:

a pump having an impeller chamber and a suction chamber, a rotatable impeller in said impeller chamber and having a generally cylindrical impeller hub surrounding an axial impeller inlet, said suction chamber having a suction inlet port below said impeller inlet and an upwardly inclined passage from said suction inlet port to said impeller inlet, a one-piece combined wear ring and liquid director having a cylindrical ring portion received on said hub, said wear ring and liquid director having a curved liquid directing portion extending downwardly from said ring portion toward said suction inlet port to separate said impeller chamber from said suction chamber and form part of said inclined passage;

wherein said combined wear ring and liquid director has a peripheral flange extending outwardly from all but the bottom peripheral portion thereof, said pump having a housing with impeller and suction chamber housing parts, said suction housing part having an opening facing toward said impeller, said opening having a peripheral shoulder extending around all but the bottom peripheral portion thereof, and said peripheral flange being in engagement with said peripheral shoulder.

* * * * *